US011165206B2

(12) United States Patent
Su et al.

(10) Patent No.: US 11,165,206 B2
(45) Date of Patent: Nov. 2, 2021

(54) RECEPTACLE CONNECTOR

(71) Applicant: Cheng Uei Precision Industry Co., LTD., New Taipei (TW)

(72) Inventors: Yu-Hung Su, New Taipei (TW); Jyun Liao, New Taipei (TW); Wen-Jie Tsou, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/904,503

(22) Filed: Jun. 17, 2020

(65) Prior Publication Data

US 2021/0151944 A1 May 20, 2021

(30) Foreign Application Priority Data

Nov. 15, 2019 (CN) ..... 201921983786.8

(51) Int. Cl.

| | |
|---|---|
| ***H01R 24/60*** | (2011.01) |
| ***H01R 13/50*** | (2006.01) |
| ***H01R 13/26*** | (2006.01) |
| ***H01R 13/6581*** | (2011.01) |

(52) U.S. Cl.

CPC ..... *H01R 24/60* (2013.01); *H01R 13/26* (2013.01); *H01R 13/50* (2013.01); *H01R 13/6581* (2013.01)

(58) Field of Classification Search

CPC ..... H01R 24/60; H01R 13/26; H01R 13/405; H01R 13/50; H01R 13/6581; H01R 13/6585

See application file for complete search history.

(56) References Cited

U.S. PATENT DOCUMENTS

| | | | | |
|---|---|---|---|---|
| 10,374,354 | B2 * | 8/2019 | Ehrensvard | H01R 13/6582 |
| 10,574,003 | B2 * | 2/2020 | Cheng | H01R 13/6597 |
| 2017/0373442 | A1 * | 12/2017 | Qiu | H01R 24/60 |

* cited by examiner

*Primary Examiner* — Oscar C Jimenez
(74) *Attorney, Agent, or Firm* — Cheng-Ju Chiang

(57) ABSTRACT

A receptacle connector includes an insulating body, an isolation plate molded in the insulating body, a plurality of first terminals, a plurality of second terminals and an insulating housing. The plurality of the first terminals are molded in the insulating body. The insulating body has a plurality of limiting protrusions protruding downward from a lower surface of the insulating body. The plurality of the second terminals are mounted to the lower surface of the insulating body. The plurality of the second terminals are disposed corresponding to intervals of the plurality of the limiting protrusions. The insulating housing is molded outside the insulating body, the plurality of the first terminals, the plurality of the second terminals and the isolation plate.

11 Claims, 16 Drawing Sheets

RECEPTACLE CONNECTOR

CROSS REFERENCE TO RELATED APPLICATION

The present application is based on, and claims priority from, China Patent Application No. 201921983786.8, filed Nov. 15, 2019, the disclosure of which is hereby incorporated by reference herein in its entirety.

BACKGROUND OF THE INVENTION

1. Field of the Invention

The present invention generally relates to a receptacle connector, and more particularly to a receptacle connector which is capable of improving a production efficiency and reducing a production cost.

2. The Related Art

Currently, when a receptacle connector in prior art is manufactured by an injection molding way, the receptacle connector need be molded three times or more times. A production efficiency of the receptacle connector is severely restricted, and a production cost of the receptacle connector is increased. The receptacle connector includes a plurality of conductive terminals. Moreover, in a number of present processing methods, the conductive terminals need be placed under a condition of connecting a metal material bridge to be shown as a whole. Undoubtedly, a complexity of the assembly process is increased, and furthermore the production efficiency of the receptacle connector is restricted and the production cost of the receptacle connector is increased.

Therefore, it is essential to provide a new-typed receptacle connector, so that the new-typed receptacle connector is capable of improving a production efficiency of the receptacle connector and reducing a production cost.

SUMMARY OF THE INVENTION

An object of the present invention is to provide a receptacle connector. The receptacle connector includes an insulating body, an isolation plate, a plurality of first terminals, a plurality of second terminals and an insulating housing. The isolation plate is molded in the insulating body. The plurality of the first terminals are molded in the insulating body. Each first terminal has a first contacting portion disposed at a front end of each first terminal and exposed outside from an upper surface of the insulating body, and a first soldering portion disposed at a rear end of each first terminal and exposed at a lower portion of a rear end of the insulating body. The insulating body has a plurality of limiting protrusions protruding downward from a lower surface of the insulating body. The plurality of the second terminals are mounted to the lower surface of the insulating body. The plurality of the second terminals are disposed corresponding to intervals of the plurality of the limiting protrusions. Each second terminal is limited between two limiting protrusions which are located at two sides of each second terminal. Each second terminal has a second contacting portion disposed at a front end of each second terminal and exposed outside to the lower surface of the insulating body, and a second soldering portion disposed at a rear end of each second terminal and exposed outside to the lower portion of the rear end of the insulating body. The insulating housing is molded outside the insulating body, the plurality of the first terminals, the plurality of the second terminals and the isolation plate. The plurality of the second terminals are molded to the insulating housing, and the first contacting portion of each first terminal is exposed outside from a front end of an upper surface of the insulating housing. The first soldering portion of each first terminal is exposed to a lower portion of a rear end of the insulating housing. The second contacting portions of the plurality of the second terminals are exposed to a lower surface of the insulating housing, and the second soldering portions of the plurality of the second terminals are exposed to the lower portion of the rear end of the insulating housing.

Another object of the present invention is to provide a receptacle connector. The receptacle connector includes an insulating body, a plurality of terminals and an insulating housing. The insulating body has a plurality of limiting protrusions protruded from and projecting beyond a surface of the insulating body. The plurality of the limiting protrusions are arranged in at least one row. The plurality of the terminals are positioned to the surface of the insulating body and disposed among the plurality of the limiting protrusions. The plurality of the terminals are isolated by the plurality of the limiting protrusions. The insulating housing is molded outside the insulating body and the plurality of the terminals. A contacting portion of each terminal is exposed outside from a surface of the insulating housing. Surfaces of a few of the limiting protrusions are exposed outside from the surface of the insulating housing, the surfaces of the few of the limiting protrusions and the surface of the insulating housing are arranged at the same level and along a horizontal direction.

Another object of the present invention is to provide a receptacle connector. The receptacle connector includes an insulating body, an isolation plate, a plurality of first terminals, a plurality of second terminals and an insulating housing. The isolation plate is molded in the insulating body. The plurality of the first terminals are molded in the insulating body. Each first terminal has a first contacting portion exposed outside from an upper surface of the insulating body, and a first soldering portion exposed at a lower portion of a rear end of the insulating body. The insulating body has a plurality of limiting protrusions protruding downward from a lower surface of the insulating body. The plurality of the limiting protrusions are arranged in two rows and along a front-to-rear direction. The two rows of the plurality of the limiting protrusions are divided into a front row of the limiting protrusions and a rear row of the limiting protrusions. The plurality of the second terminals are mounted to the lower surface of the insulating body, and disposed corresponding to intervals of the plurality of the limiting protrusions. Each second terminal is limited between two limiting protrusions which are located at two sides of each second terminal. Each second terminal has a second contacting portion exposed outside to the lower surface of the insulating body, and a second soldering portion exposed outside to the lower portion of the rear end of the insulating body. The second contacting portions of the plurality of the second terminals are isolated by the front row of the limiting protrusions. The second soldering portions of the plurality of the second terminals are isolated by the rear row of the limiting protrusions. The insulating housing is molded outside the insulating body, the plurality of the first terminals, the plurality of the second terminals and the isolation plate. The first contacting portion of each first terminal is exposed outside from a front end of an upper surface of the insulating housing. The first soldering portion of each first terminal is exposed to a lower portion of a rear end of the insulating housing. The second contacting portions of the plurality of the second terminals are exposed to a lower surface of the insulating housing, and the second soldering portions of the plurality of the second terminals are exposed to the lower portion of the rear end of the insulating housing.

As described above, the plurality of the first terminals and the isolation plate are firstly molded the insulating body, and then the plurality of the second terminals placed on the lower surface of the insulating body 1 are limited by the plurality of limiting protrusions protruding from the lower surface of the insulating body, and the insulating housing may be molded outside of the insulating body, so the entire manufacturing process of the receptacle connector only requires two injection molding procedures for improving a production efficiency of the receptacle connector and reducing a production cost of the receptacle connector. At the same time, the plurality of second terminals are limited by the plurality of the limiting protrusions to allows the plurality of the second terminals to be stably positioned to the insulating body. Furthermore, it is unnecessary to connect the plurality of the second terminals through a metal bridge, so a complexity of an assembly process of the receptacle connector is lowered.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
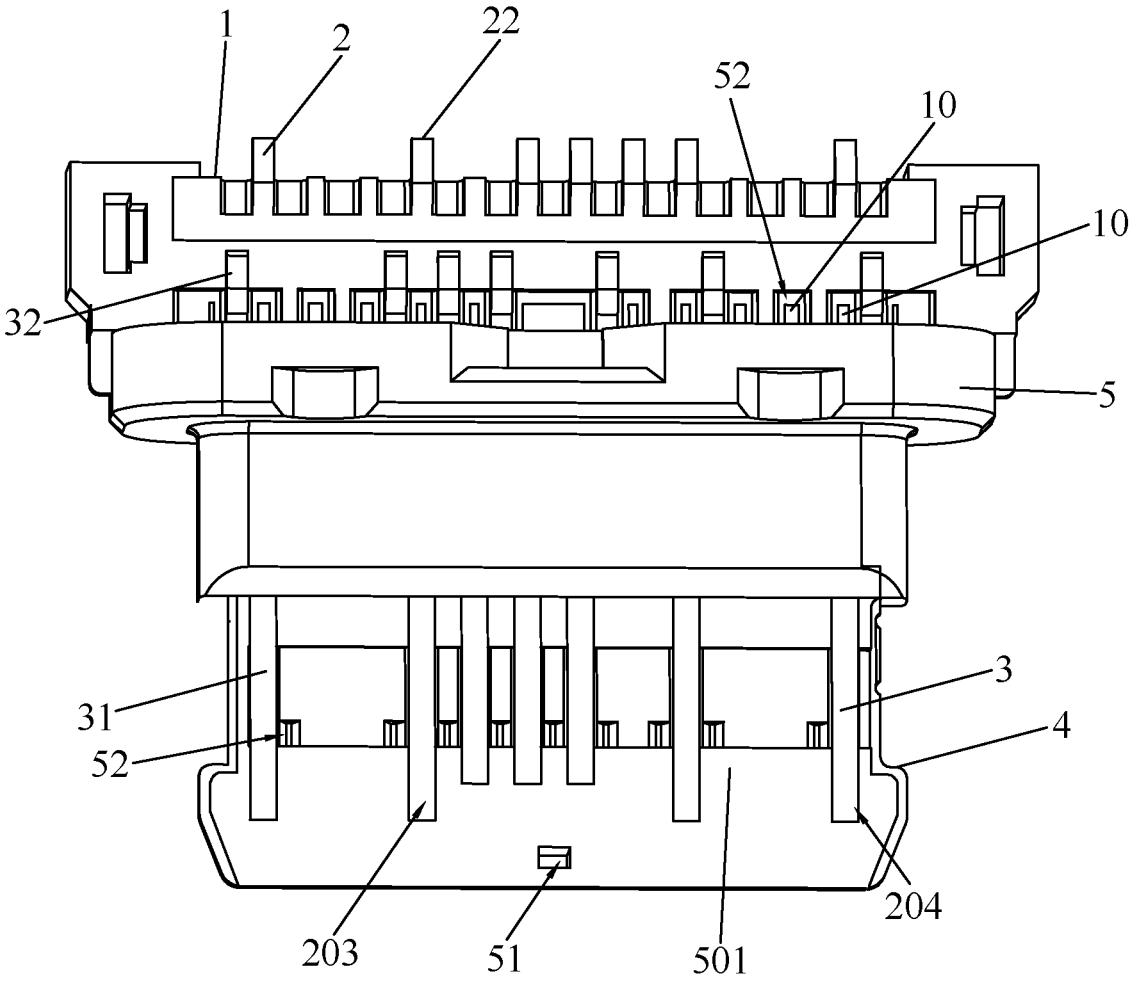
FIG. 1 is a perspective view of a receptacle connector in accordance with a first preferred embodiment of the present invention.
Figure 2:
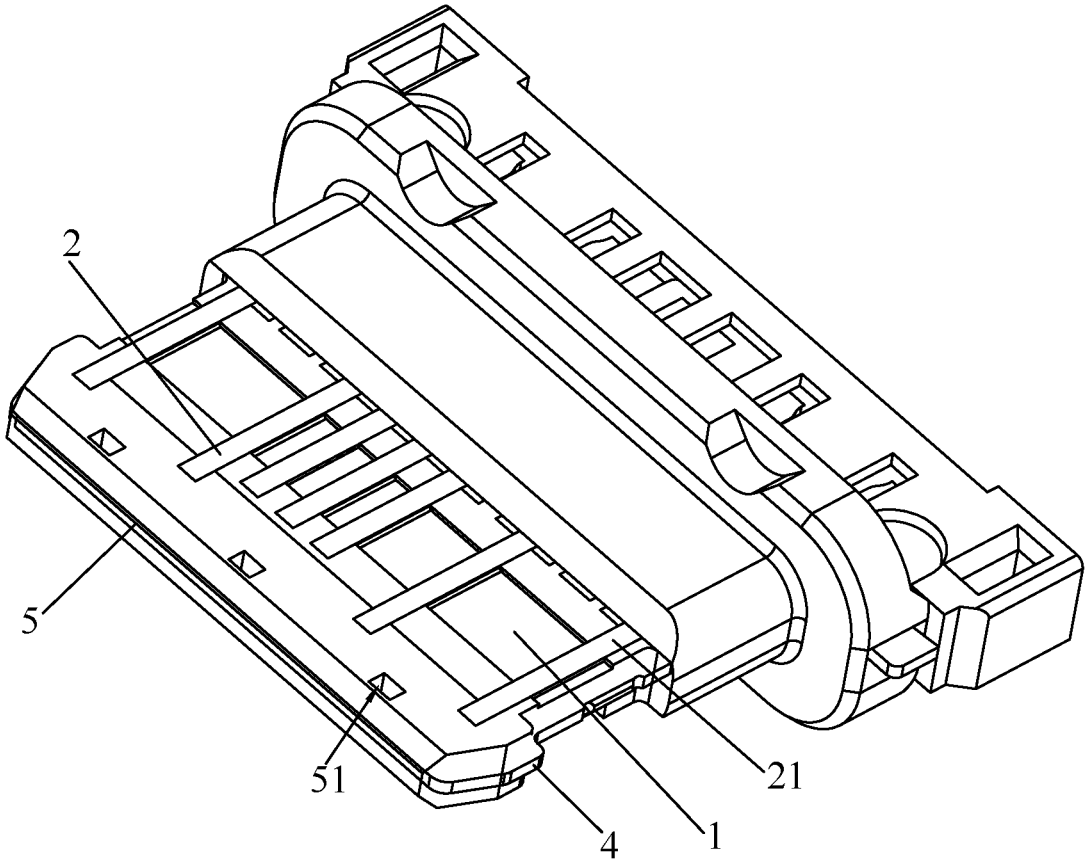
FIG. 2 is another perspective view of the receptacle connector of FIG. 1.
Figure 3:
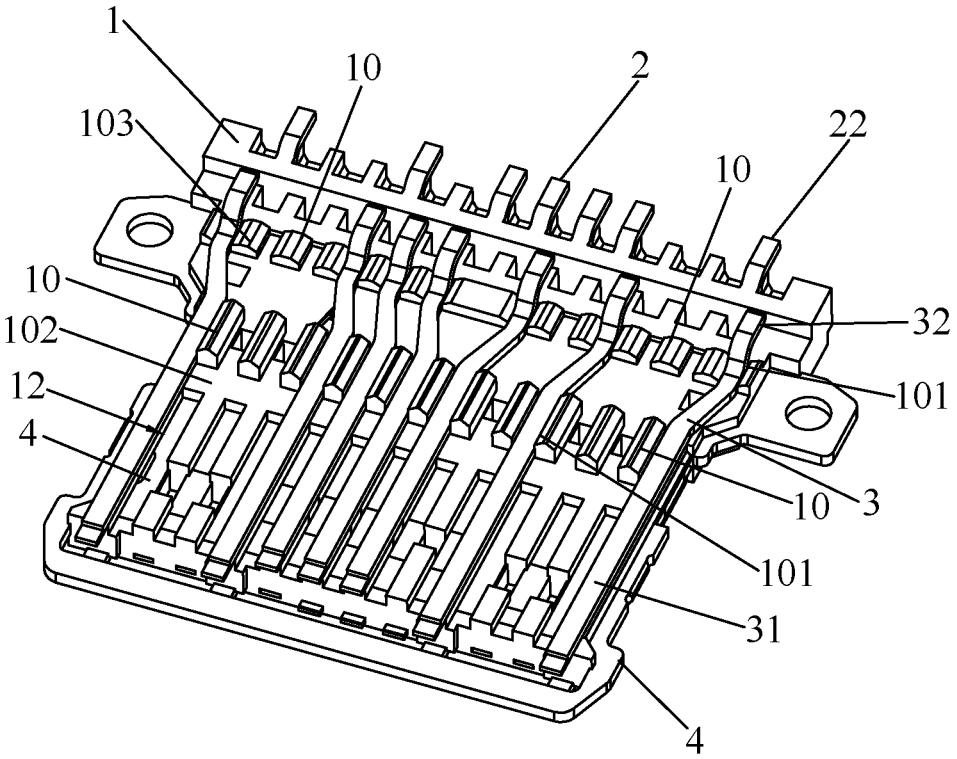
FIG. 3 is a partially perspective view of the receptacle connector of FIG. 2, wherein an insulating housing of the receptacle connector is omitted.
Figure 4:
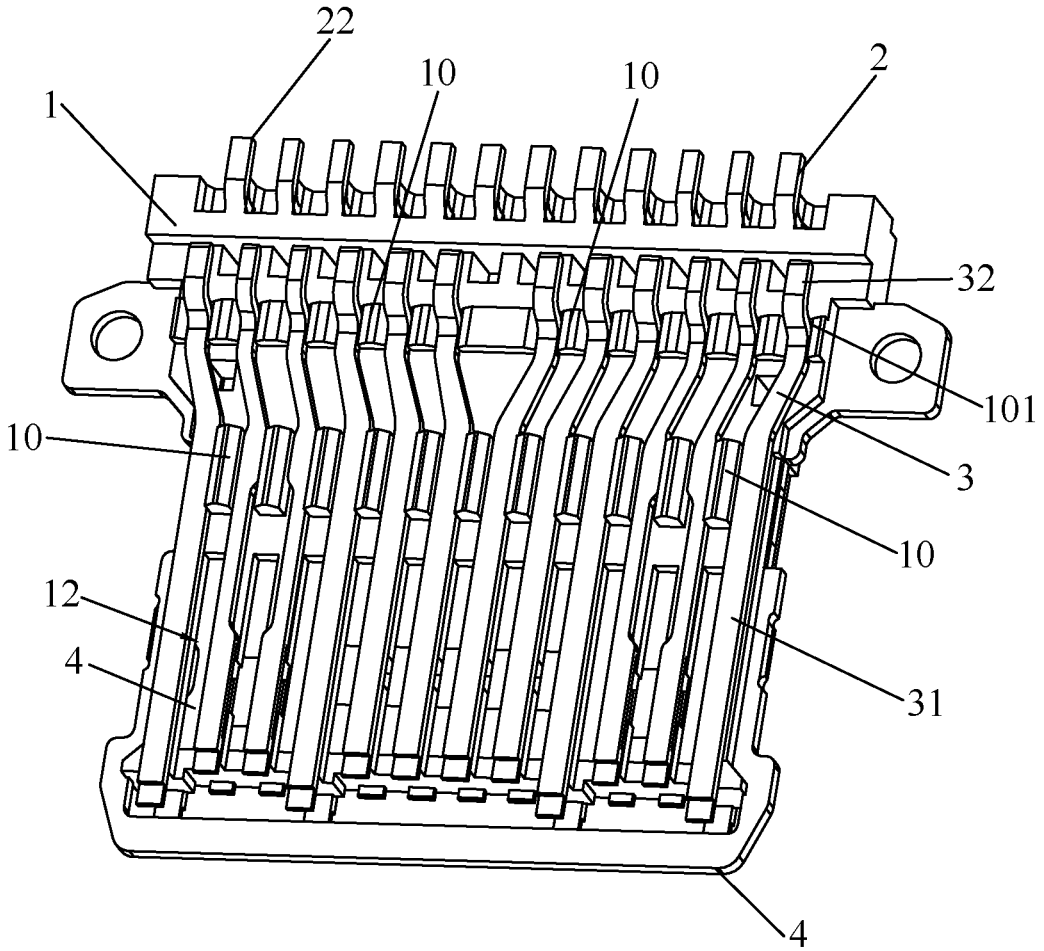
FIG. 4 is a perspective view of the receptacle connector in accordance with a second preferred embodiment of the present invention, wherein the insulating housing is omitted.
Figure 5:
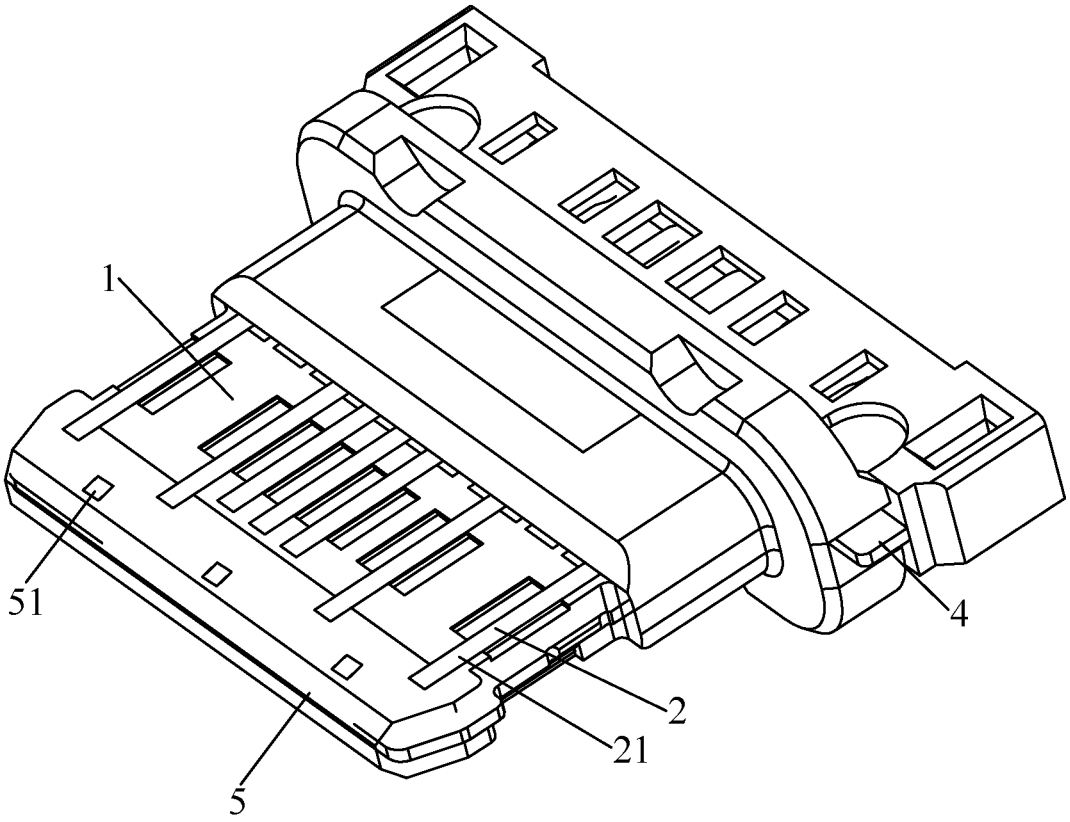
FIG. 5 is a perspective view of the receptacle connector in accordance with a third preferred embodiment of the present invention.

With reference to FIG. 1 to FIG. 16, a receptacle connector 100 in accordance with a first preferred embodiment, a second preferred embodiment, a third preferred embodiment, a fourth preferred embodiment and a fifth preferred embodiment of the present invention is shown. The receptacle connector 100 includes an insulating body 1, a plurality of terminals 203, an isolation plate 4 and an insulating housing 5. The plurality of the terminals 203 include a plurality of first terminals 2 and a plurality of second terminals 3.

The plurality of the first terminals 2 and the isolation plate 4 are molded in the insulating body 1. The plurality of the first terminals 2 are disposed to an upper surface of the insulating body 1. Each first terminal 2 has a first contacting portion 21 disposed at a front end of each first terminal 2 and exposed outside from the upper surface of the insulating body 1, and a first soldering portion 22 disposed at a rear end of each first terminal 2 and exposed at a lower portion of a rear end of the insulating body 1. The insulating body 1 has a plurality of limiting protrusions 10 protruded from and projecting beyond a surface 102 of the insulating body 1. The plurality of the limiting protrusions 10 are arranged in at least one row. The insulating body 1 has the plurality of the limiting protrusions 10 protruded downward from a lower surface of the insulating body 1. The plurality of the limiting protrusions 10 are arranged in two rows. Front ends of the first contacting portions 21 of the plurality of the first terminals 2 project beyond a front surface of the insulating body 1.

The plurality of the terminals 203 are positioned to the surface 102 of the insulating body 1 and disposed among the plurality of the limiting protrusions 10. The plurality of the terminals 203 are isolated by the plurality of the limiting protrusions 10. The plurality of the second terminals 3 are positioned to the lower surface of the insulating body 1 and disposed among the plurality of the limiting protrusions 10. The plurality of the second terminals 3 are isolated by the plurality of the limiting protrusions 10. The plurality of the second terminals 3 are disposed corresponding to intervals 101 of the plurality of the limiting protrusions 10. Each second terminal 3 is limited between two limiting protrusions 10 which are located at two sides of each second terminal 3. The insulating housing 5 is molded outside the insulating body 1 and the plurality of the terminals 203. A contacting portion 204 of each terminal 203 is exposed outside from a surface 501 of the insulating housing 5. Surfaces 103 of a few of the limiting protrusions 10 are exposed outside from the surface 501 of the insulating housing 5, the surfaces 103 of the few of the limiting protrusions 10 and the surface 501 of the insulating housing 5 are arranged at the same level and along a horizontal direction. The insulating housing 5 is molded outside the insulating body 1, the plurality of the first terminals 2, the plurality of the second terminals 3 and the isolation plate 4. The plurality of the second terminals 3 are molded to the insulating housing 5, and the first contacting portion 21 of each first terminal 2 is exposed outside from a front end of an upper surface of the insulating housing 5. The first soldering portion 22 of each first terminal 2 is exposed to a lower portion of a rear end of the insulating housing 5.

The plurality of the second terminals 3 are mounted to the lower surface of the insulating body 1. Each second terminal 3 has a second contacting portion 31 disposed at a front end of each second terminal 3 and exposed outside to a lower surface of the insulating body 1, and a second soldering portion 32 disposed at a rear end of each second terminal 3 and exposed outside to the lower portion of the rear end of the insulating body 1. The second soldering portions 32 of the plurality of the second terminals 3 are located in front of the first soldering portions 22 of the plurality of the first terminals 2. The second contacting portions 31 of the plurality of the second terminals 3 are exposed to a lower surface of the insulating housing 5, and the second soldering portions 32 of the plurality of the second terminals 3 are exposed to the lower portion of the rear end of the insulating housing 5.

In the above-mentioned process of assembling the receptacle connector 100 in accordance with the present invention, firstly, the plurality of the first terminals 2 and the isolation plate 4 are molded to the insulating body 1, secondly, the plurality of the second terminals 3 are disposed to the lower surface of the insulating body 1 and are limited by the plurality of the limiting protrusions 10, thirdly, the insulating housing 5 is molded outside the insulating body 1 together with the plurality of the first terminals 2, the plurality of the second terminals 3 and the isolation plate 4, and the entire manufacturing process of the receptacle connector 100 only requires two injection molding procedures, so that a production efficiency of the receptacle connector 100 is improved, and correspondingly, the entire manufacturing process of the receptacle connector 100 which only requires two injection molding procedures is beneficial to reduce a production cost of the receptacle connector. Simultaneously, the plurality of the second terminals 3 are stably located to the insulating body 1 by virtue of the plurality of the limiting protrusions 10 limiting positions of the plurality of the second terminals 3, and the plurality of the second terminals 3 are without needing to be connected by a metal material bridge, so a complexity of an assembly process of the receptacle connector 100 is lowered, the production efficiency of the receptacle connector 100 is further improved and the production cost of the receptacle connector 100 is further reduced.

With reference to FIG. 3 to FIG. 16, in order to preferably limit the plurality of the second terminals 3 to the insulating body 1, in the first preferred embodiment, the second preferred embodiment, the third preferred embodiment, the fourth preferred embodiment and the fifth preferred embodiment, the plurality of the limiting protrusions 10 are arranged in the two rows and along a front-to-rear direction. The two rows of the limiting protrusions 10 are spaced from each other. The two rows of the plurality of the limiting protrusions 10 are divided into a front row of the limiting protrusions 10 and a rear row of the limiting protrusions 10. Each row of the limiting protrusions 10 is shown as a comb-like structure. The second contacting portions 31 of the plurality of the second terminals 3 are isolated by the front row of the limiting protrusions 10. The second soldering portions 32 of the plurality of the second terminals 3 are isolated by the rear row of the limiting protrusions 10.

With reference to FIG. 3 to FIG. 16, in the first preferred embodiment, the second preferred embodiment, the third preferred embodiment, the fourth preferred embodiment and the fifth preferred embodiment, at least a few limiting protrusions 10 are designed to proceed an up-down limitation of the insulating body 1 at the time of the insulating housing 5 being molded to the insulating body 1. That is to say, at least the few limiting protrusions 10 are capable of contacting with and abutting against a mold (not shown) correspondingly for cooperating other designs of the receptacle connector 100 to together proceed an up-down limitation of the receptacle connector 100, when the insulating housing 5 is molded, the insulating body 1, the plurality of the first terminals 2, the isolation plate 4 and the plurality of the second terminals 3 are beneficial to be located in the corresponding mold by virtue of the design of the receptacle connector 100. Therefore, lower surfaces of the few of the limiting protrusions 10 are exposed outside the insulating housing 5. The lower surfaces of the few of the limiting protrusions 10 and the lower surface of the insulating housing 5 are arranged at the same level and along the horizontal direction.

With reference to FIG. 3 to FIG. 16 again, in the first preferred embodiment, the second preferred embodiment, the third preferred embodiment, the fourth preferred embodiment and the fifth preferred embodiment, a front end of the isolation plate 4 extends beyond a front surface and two side surfaces of the insulating body 1. A front end of the insulating body 1 is connected with at least two spaced step portions 11 arranged at an interval. The front end of the isolation plate 4 is molded in middles of the at least two step portions 11. The front surface of the insulating body 1 is connected with rear surfaces of the at least two step portions 11. An upper surface and a lower surface of each step portion 11 protrude oppositely to form an upper limit portion 111 and a lower limit portion 112, respectively.

The upper limit portion 111 and the lower limit portion 112 are designed to limit an upper surface and a lower surface of the front end of the isolation plate 4 at the time of the insulating housing 5 being molded to the insulating body 1, the plurality of the first terminals 2, the plurality of the second terminals 3 and the isolation plate 4. When the insulating housing 5 is molded, the upper limit portion 111 and the lower limit portion 112 of each step portion 11 are capable of correspondingly abutting against and contacting with the mold to limit the upper surface and the lower surface of the front end of the isolation plate 4 by design of each step portion 11. After an effect of each step portion 11 limiting the front end of the isolation plate 4 is combined with a limiting effect of each limiting protrusion 10 on the insulating body 1, the insulating body 1, the plurality of the first terminals 2, the isolation plate 4 and the plurality of the second terminals 3 are molded in and located in the corresponding mold more conveniently.

With reference to FIG. 1, FIG. 2, FIG. 5, FIG. 6, FIG. 8 and FIG. 9, in the first preferred embodiment, the third preferred embodiment and the fourth preferred embodiment, an upper surface and a lower surface of the front end of the insulating housing 5 have a plurality of cutout holes 51 corresponding to the front end of the isolation plate 4, and the front end of the isolation plate 4 is partially exposed at the plurality of the cutout holes 51. Specifically, when the insulating housing 5 is molded, a specially designed thimble structure in the mold is capable of being used to limit the front end of the middle isolation plate 4. Therefore, the insulating body 1, the plurality of the first terminals 2, the isolation plate 4 and the plurality of the second terminals 3 are located in the corresponding mold.

With reference to FIG. 3, FIG. 4, FIG. 7 and FIG. 10, in the first preferred embodiment, the second preferred embodiment, the third preferred embodiment and the fourth preferred embodiment, two sides of the second contacting portion 31 of each second terminal 3 has at least one lacking groove 12 recessed upward in the lower surface of the insulating body 1. Specifically, several portions of the lower surface of the insulating body 1 are recessed upward to form a plurality of spaced lacking grooves 12. The second contacting portions 31 of the plurality of the second terminals 3 are spaced by the plurality of the lacking grooves 12. At least two lacking grooves 12 are located at two sides of the second contacting portion 31 of each second terminal 3. The isolation plate 4 is exposed to the plurality of the lacking grooves 12, and the insulating housing 5 is filled in the plurality of the lacking grooves 12 during molding the insulating housing 5.

The plurality of the limiting protrusions 10 are located behind rears of the plurality of the second contacting portions 31 and the plurality of the lacking grooves 12. When the insulating body 1 is molded, a limitation of the isolation plate 4 is capable of being increased by design of the plurality of the lacking grooves 12. Moreover, when the insulating housing 5 is molded, plastic is capable of being filled to both sides of each second terminal 3 which is located between the two second terminals 3 of the two outermost sides of the lower surface of the insulating body 1 to grasp each second terminal 3 which is located between the two second terminals 3 of the two outermost sides of the lower surface of the insulating body 1 tighter, and the receptacle connector 100 including the plurality of the second terminals 3 has a better appearance. The plurality of the lacking grooves 12 are aligned with the front row of the limiting protrusions 10 respectively along the front-to-rear direction.

Figure 6:
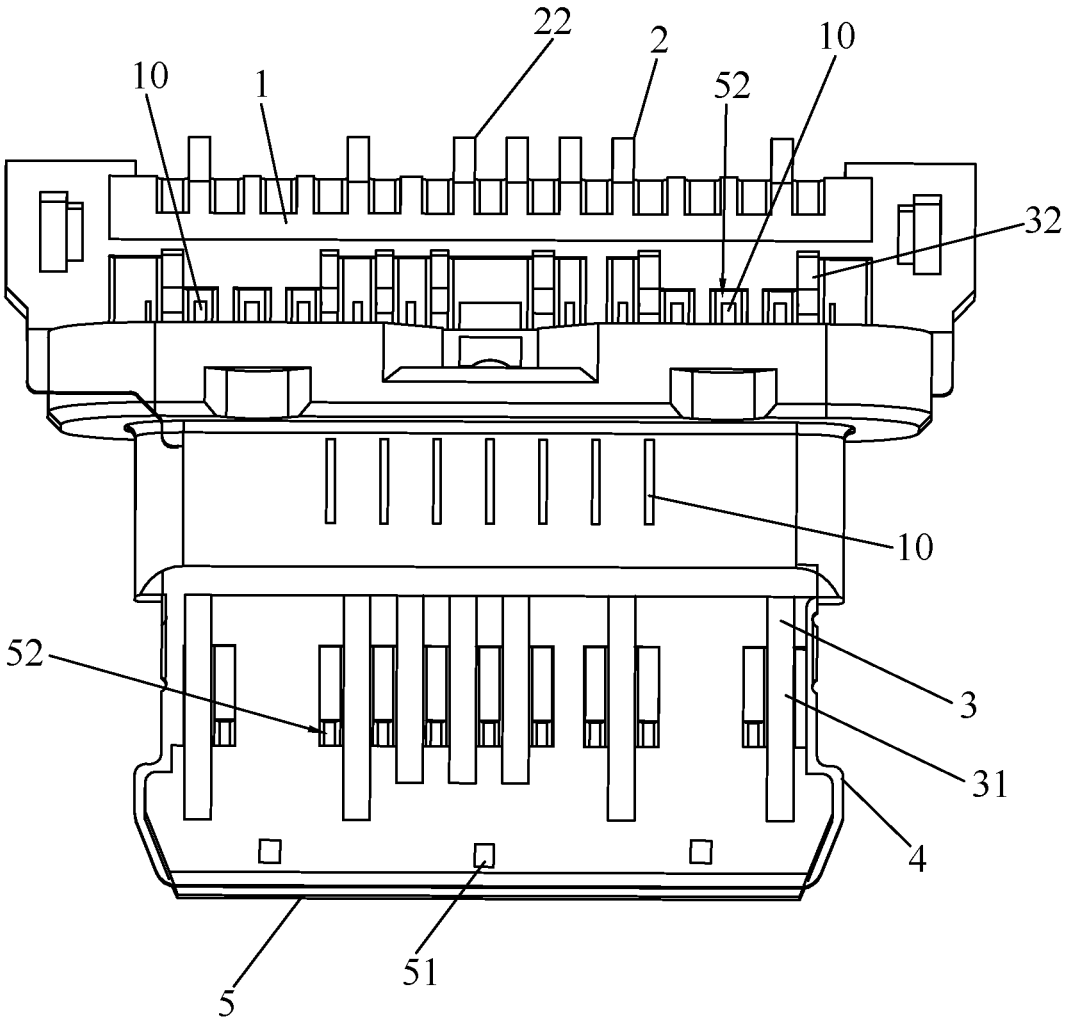
FIG. 6 is another perspective view of the receptacle connector of FIG. 5.
Figure 7:
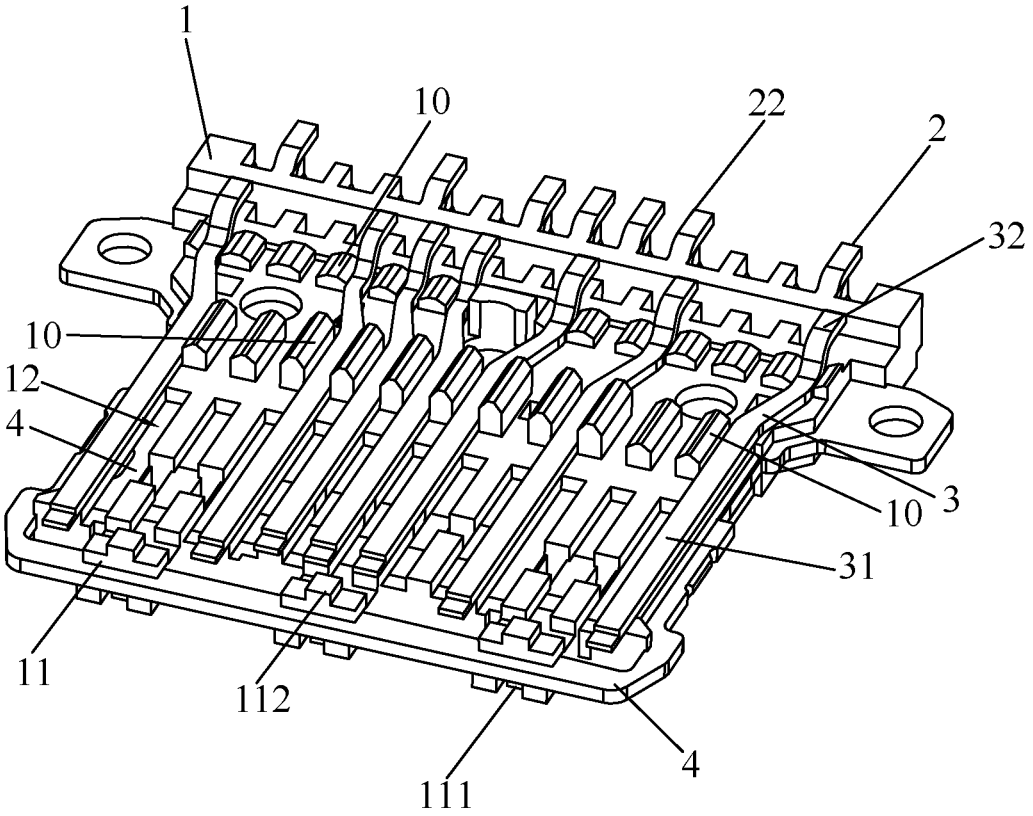
FIG. 7 is a perspective view of the receptacle connector of FIG. 6, wherein the insulating housing is omitted.
Figure 8:
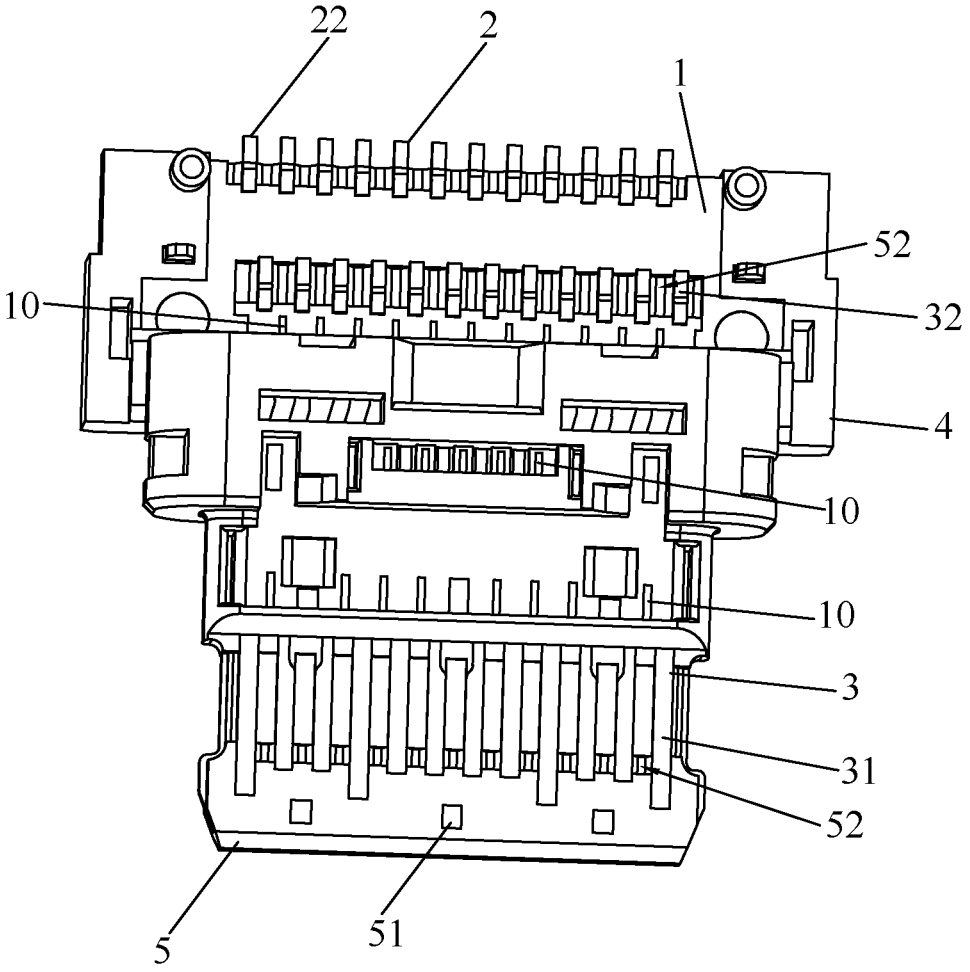
FIG. 8 is a perspective view of the receptacle connector in accordance with a fourth preferred embodiment of the present invention.
Figure 9:
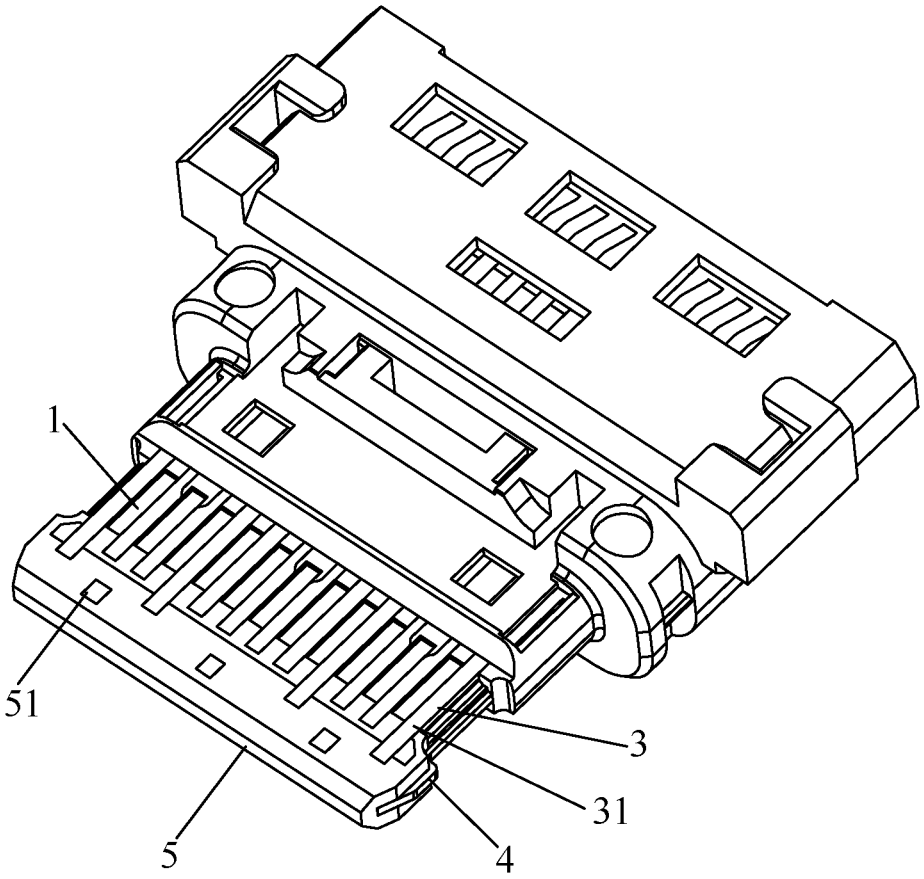
FIG. 9 is another perspective view of the receptacle connector of FIG. 8.
Figure 10:
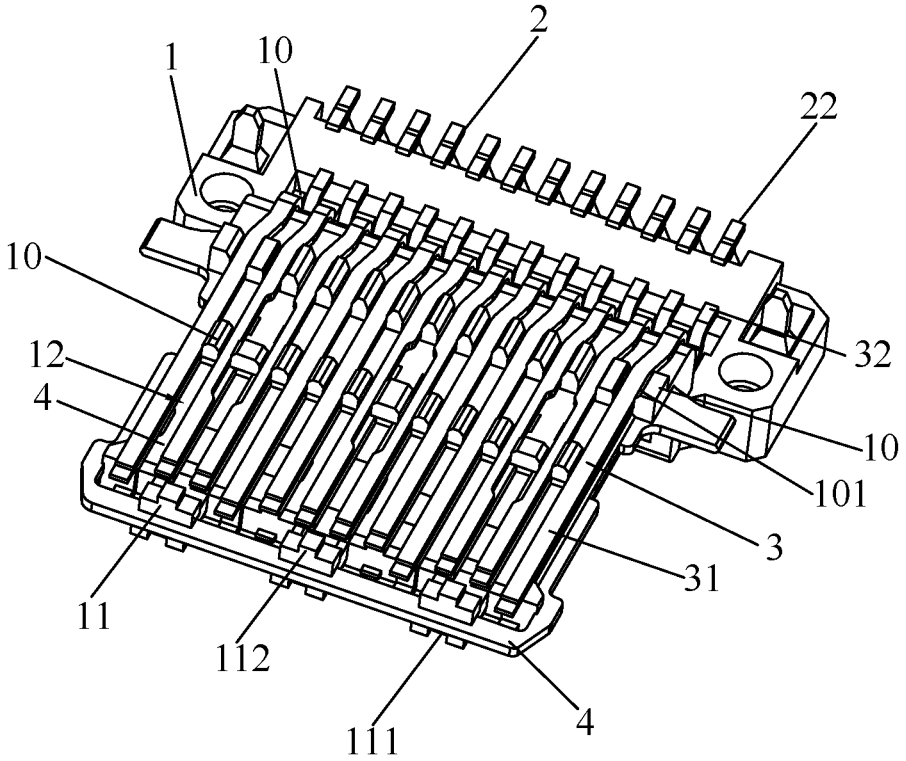
FIG. 10 is a perspective view of the receptacle connector of FIG. 8, wherein the insulating housing is omitted.
Figure 11:
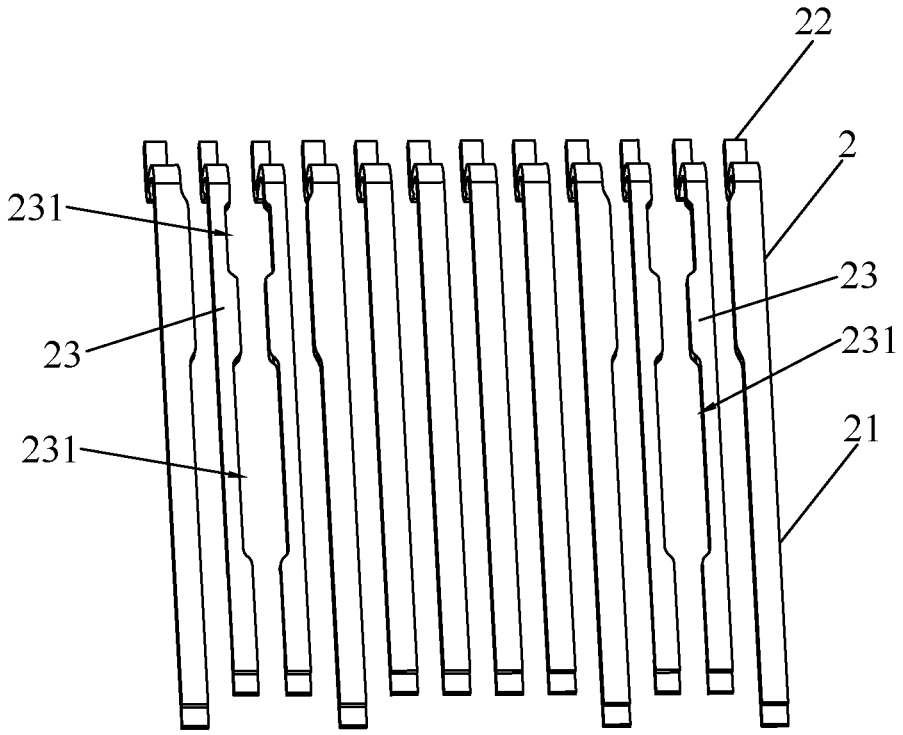
FIG. 11 is a perspective view of a plurality of first terminals of the receptacle connector in accordance with the second preferred embodiment of the present invention.
Figure 12:
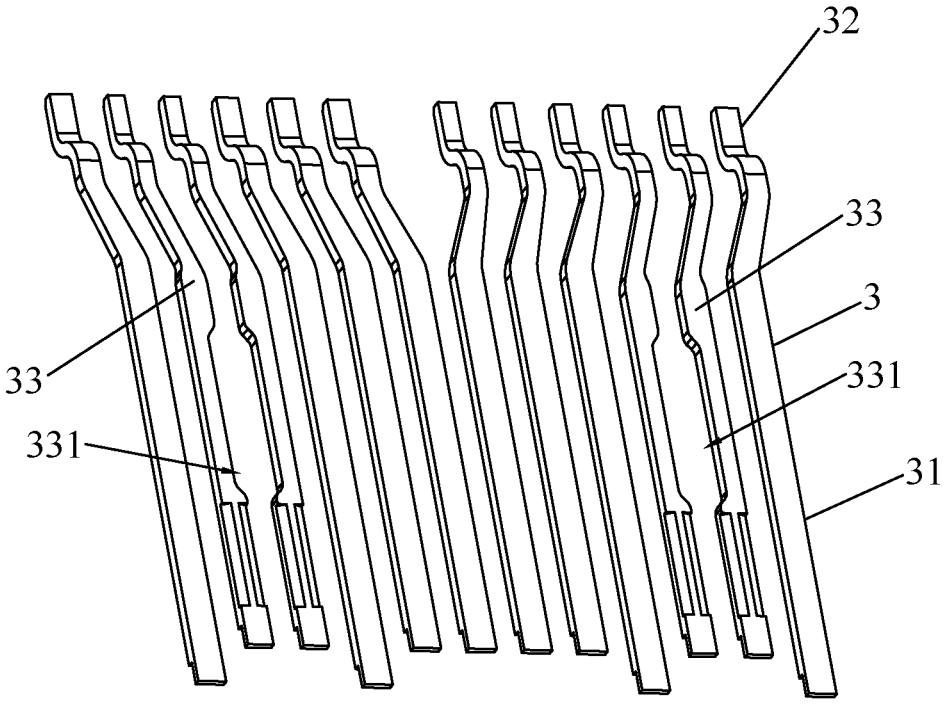
FIG. 12 is a perspective view of a plurality of second terminals of the receptacle connector in accordance with the second preferred embodiment of the present invention.
Figure 13:
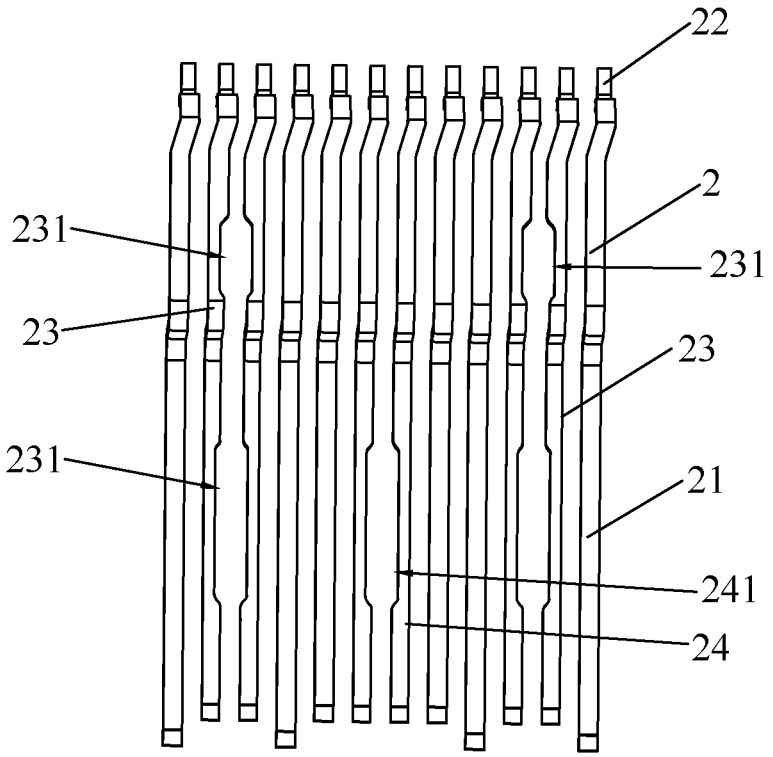
FIG. 13 is a perspective view of the plurality of the first terminals of the receptacle connector in accordance with the fourth preferred embodiment of the present invention.
Figure 14:
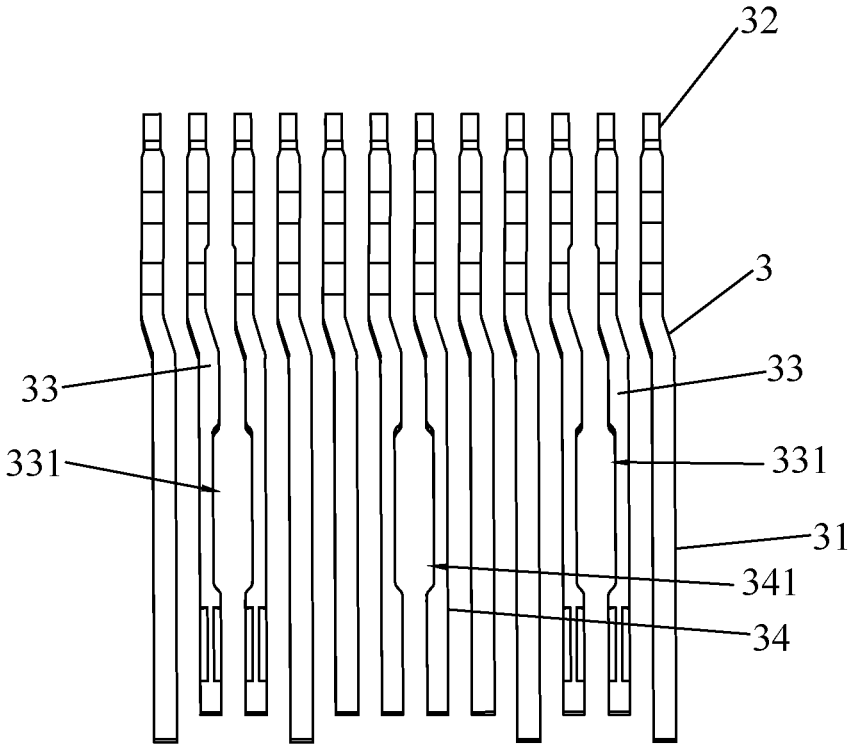
FIG. 14 is a perspective view of the plurality of the second terminals of the receptacle connector in accordance with the fourth preferred embodiment of the present invention.

With reference to FIG. 1, FIG. 6 and FIG. 8, in the first preferred embodiment, the third preferred embodiment and the fourth preferred embodiment, two sides of the second contacting portion 31 of each second terminal 3 have at least one discharge opening 52 recessed inward in at least one portion of the lower surface of the insulating housing 5. Specifically, several portions of the lower surface of the insulating housing 5 are recessed inward to form a plurality of the discharge openings 52, and the plurality of the discharge openings 52 are arranged in two rows and along the front-to-rear direction. The second contacting portions 31 of the plurality of the second terminals 3 are isolated by the plurality of the discharge openings 52 which are arranged in a front row. The plurality of the discharge openings 52 which are arranged in the front row penetrate through a front end of the lower surface of the insulating housing 5. At least two discharge openings 52 are located at inner sides of the second contacting portions 31 of two second terminals 3 located at the two outermost sides of the lower surface of the insulating housing 5, and at least two discharge openings 52 are formed and located at the two sides of the second contacting portion 31 of each second terminal 3 which is located between the second contacting portions 31 of two second terminals 3 of the two outermost sides of the lower surface of the insulating housing 5. Because the plurality of the discharge openings 52 are cooperated with the plurality of the second terminals 3, when the corresponding mold is closed, a position of each second terminal 3 is capable of being guided accurately for increasing a limitation of each second terminal 3. Specifically, the insulating housing 5 defines two discharge openings 52 penetrating through the lower surface of the insulating housing 5 and disposed to the two sides of the second contacting portion 31 of each second terminal 3.

The second soldering portions 32 of the plurality of the second terminals 3 are isolated by the plurality of the discharge openings 52 which are arranged in a rear row. The plurality of the discharge openings 52 which are arranged in the rear row penetrate through a rear end of the lower surface of the insulating housing 5. Two sides of the second soldering portion 32 of each second terminal 3 have the at least one discharge opening 52 recessed inward in the at least one portion of the lower surface of the insulating housing 5. Areas adjacent to the two sides of the second soldering portion 32 of each second terminal 3 have the two discharge openings 52 penetrating through the lower surface of the insulating housing 5 for accurately guiding each second terminal 3 in a more excellent manner so as to increase the limitation of each second terminal 3. The plurality of the discharge openings 52 which are arranged in the rear row are corresponding to the limiting protrusions 10 which are arranged in the rear row and shown as the comb-like structure.

With reference to FIG. 11 to FIG. 14, in the second preferred embodiment, the fourth preferred embodiment and the fifth preferred embodiment, the plurality of the first terminals 2 include two pairs of first differential signal terminals 23. At least two portions of two adjacent sides of each pair of the first differential signal terminals 23 are recessed oppositely to form at least one pair of facing first recessed areas 231. The two adjacent sides of each pair of the first differential signal terminals 23 face each other. The at least one pair of the facing first recessed areas 231 are spaced from each other. The plurality of the second terminals 3 include two pairs of second differential signal terminals 33. At least two portions of two adjacent sides of each pair of the second differential signal terminals 33 are recessed oppositely to form at least one pair of facing second recessed areas 331. The two adjacent sides of each pair of the second differential signal terminals 33 face each other. The at least one pair of the facing second recessed areas 331 are spaced from each other. High-frequency characteristics of the two pairs of the first differential signal terminal 23 and the two pairs of the second differential signal terminals 33 are effectively improved by design of the two pairs of the first differential signal terminal 23 and the two pairs of the second differential signal terminal 33. In practice, each first differential signal terminal 23 is provided with two spaced first recessed areas 231 along the front-to-rear direction.

With reference to FIG. 11 to FIG. 14, in the second preferred embodiment, the fourth preferred embodiment and the fifth preferred embodiment, two sides of an upper surface of each second differential signal terminal 33 facing inward are designed as C chamfer angles. High-frequency characteristics of the two pairs of the second differential signal terminals 33 are effectively improved by the design of each second differential signal terminal 33. In practice, each second differential signal terminal 33 has one second recessed area 331, and a portion of each second differential signal terminal 33 which is shown as the C chamfer angle is located in front of the one second recessed area 331.

Preferably, the plurality of the first terminals 2 further include a pair of first signal terminals 24, and the plurality of the second terminals 3 further include a pair of second signal terminals 34. Two adjacent sides of two fronts of each pair of the first signal terminals 24 are recessed opposite to each other to form a pair of facing first recessed regions 241. The pair of the facing first recessed regions 241 are spaced from each other. Two adjacent sides of two fronts of each pair of the second signal terminals 34 are recessed opposite to each other to form a pair of facing second recessed regions 341. The pair of the facing second recessed regions 341 are spaced from each other. High-frequency characteristics of the pair of the first signal terminals 24 and the pair of the second signal terminals 34 are effectively improved by design of the pair of the first signal terminals 24 and the pair of the second signal terminals 34.

Figure 15:
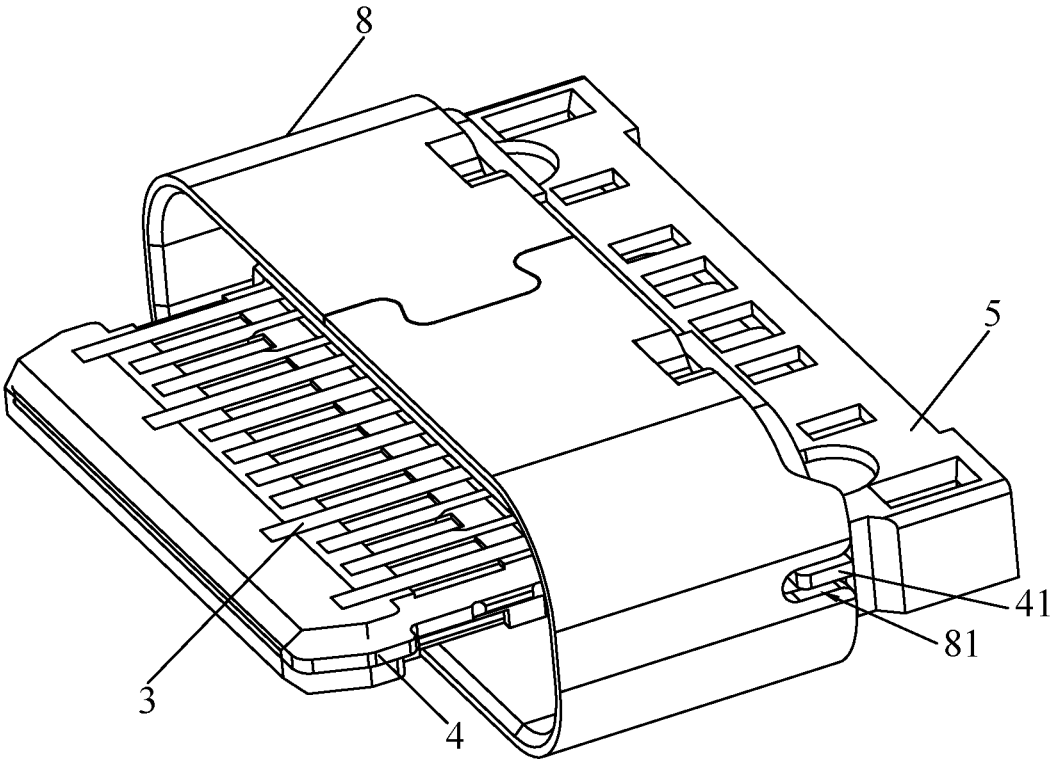
FIG. 15 is a perspective view of the receptacle connector in accordance with a fifth preferred embodiment of the present invention, wherein a shielding shell is surrounded around the receptacle connector.
Figure 16:
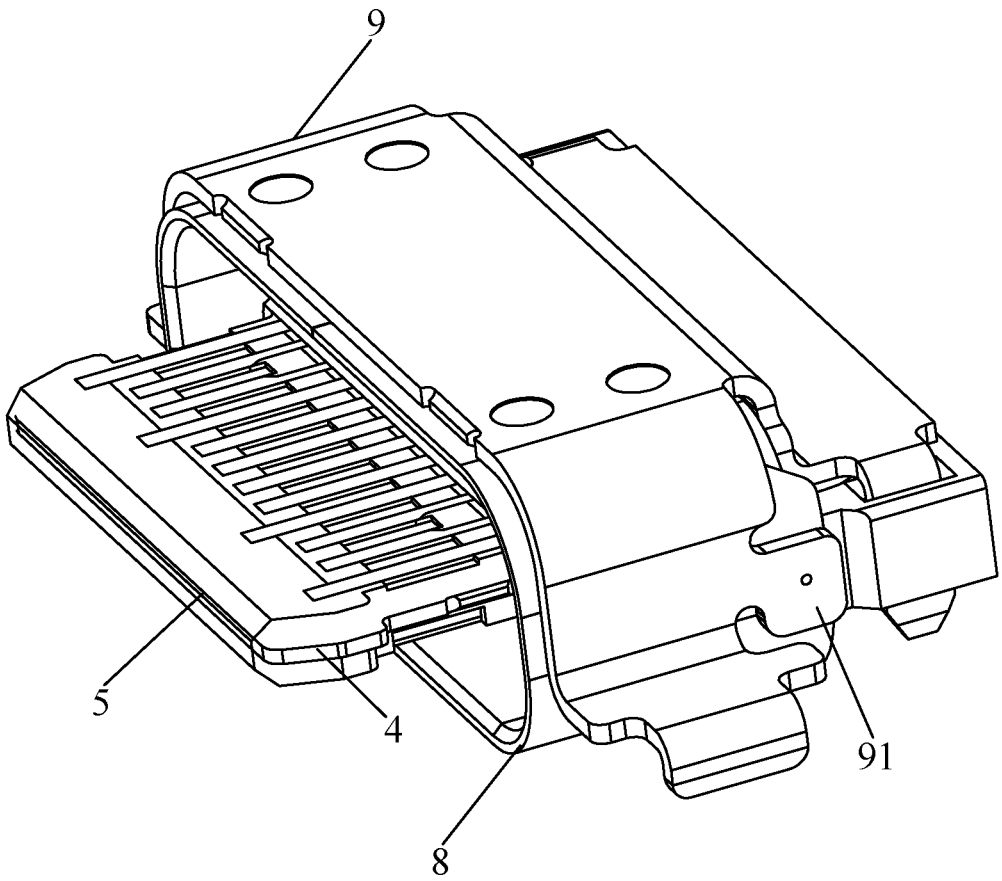
FIG. 16 is a perspective view of the receptacle connector, wherein an outer cover is covered to the shielding shell of the receptacle connector of FIG. 15.

With reference to FIG. 15 and FIG. 16, in the fifth preferred embodiment, the receptacle connector 100 further includes a shielding shell 8 surround an outside of the insulating housing 5, and an outer cover 9 covered on the shielding shell 8. The isolation plate 4 has two extending plates 41 exposed outside from two opposite sides of the insulating housing 5. Two rear ends of two sides of the shielding shell 8 are recessed frontward to form two notches 81. Two rear ends of two sides of the outer cover 9 are connected with two elastic pieces 91. The two extending plates 41 are received in the two notches 81, respectively. The two elastic pieces 91 are overlapped with and connected with the two extending plates 41. The isolation plate 4 is capable of forming a loop by the outer cover 9 soldered on a circuit board, so that a better high-frequency characteristic of the receptacle connector 100 is achieved by a cooperation design of the shielding shell 8, the insulating housing 5, the isolation plate 4 and the outer cover 9.

As described above, the plurality of the first terminals 2 and the isolation plate 4 are firstly molded the insulating body 1, and then, the plurality of the second terminals 3 placed on the lower surface of the insulating body 1 are limited by the plurality of limiting protrusions 10 protruding from the lower surface of the insulating body 1, and the insulating housing 5 may be molded outside of the insulating body 1, so the entire manufacturing process of the receptacle connector 100 only requires two injection molding procedures for improving the production efficiency of the receptacle connector 100 and reducing the production cost of the receptacle connector 100. At the same time, the plurality of second terminals 3 are limited by the plurality of the limiting protrusions 10 to allows the plurality of the second terminals 3 to be stably positioned to the insulating body 1. Furthermore, it is unnecessary to connect the plurality of the second terminals 3 through a metal bridge, so a complexity of the assembly process of the receptacle connector 100 is lowered.

What is claimed is:

1. A receptacle connector, comprising:

an insulating body;

an isolation plate being molded in the insulating body;

a plurality of first terminals molded in the insulating body, each first terminal having a first contacting portion disposed at a front end of each first terminal and exposed outside from an upper surface of the insulating body, and a first soldering portion disposed at a rear end of each first terminal and exposed at a lower portion of a rear end of the insulating body, the insulating body having a plurality of limiting protrusions protruding downward from a lower surface of the insulating body;

a plurality of second terminals mounted to the lower surface of the insulating body, the plurality of the second terminals being disposed corresponding to intervals of the plurality of the limiting protrusions, each second terminal being limited between two limiting protrusions which are located at two sides of each second terminal, each second terminal having a second contacting portion disposed at a front end of each second terminal and exposed outside to the lower surface of the insulating body, and a second soldering portion disposed at a rear end of each second terminal and exposed outside to the lower portion of the rear end of the insulating body; and an insulating housing molded outside the insulating body, the plurality of the first terminals, the plurality of the second terminals and the isolation plate, the plurality of the second terminals being molded to the insulating housing, and the first contacting portion of each first terminal being exposed outside from a front end of an upper surface of the insulating housing, the first soldering portion of each first terminal being exposed to a lower portion of a rear end of the insulating housing, the second contacting portions of the plurality of the second terminals being exposed to a lower surface of the insulating housing, and the second soldering portions of the plurality of the second terminals being exposed to the lower portion of the rear end of the insulating housing;

wherein a front end of the isolation plate extends beyond a front surface of the insulating body, a front end of the insulating body is connected with at least two step portions arranged at an interval, the front end of the isolation plate is molded in middles of the at least two step portions, an upper surface and a lower surface of each step portion protrude oppositely to form an upper limit portion and a lower limit portion, respectively, the upper limit portion and the lower limit portion are designed to limit an upper surface and a lower surface of the front end of the isolation plate at the time of the insulating housing being molded to the insulating body, the plurality of the first terminals, the plurality of the second terminals and the isolation plate.

2. The receptacle connector as claimed in claim 1, wherein the plurality of the limiting protrusions are arranged in two rows and along a front-to-rear direction, the two rows of the limiting protrusions are spaced from each other, each row of the limiting protrusions is shown as a comb-like structure.

3. The receptacle connector as claimed in claim 1, wherein at least a few limiting protrusions are designed to proceed an up-down limitation of the insulating body at the time of the insulating housing being molded to the insulating body.

4. The receptacle connector as claimed in claim 1, wherein a front end of the isolation plate extends beyond the insulating body, an upper surface and a lower surface of a front end of the insulating housing have a plurality of cutout holes corresponding to the front end of the isolation plate, and the isolation plate is partially exposed at the plurality of the cutout holes.

5. The receptacle connector as claimed in claim 1, wherein several portions of the lower surface of the insulating body are recessed upward to form a plurality of lacking grooves, the second contacting portions of the plurality of the second terminals are spaced by the plurality of the lacking grooves, at least two lacking grooves are located at two sides of the second contacting portion of each second terminal, the isolation plate is exposed to the plurality of the lacking grooves, and the insulating housing is filled in the plurality of the lacking grooves during molding the insulating housing, the plurality of the limiting protrusions are located behind rears of the plurality of the second contacting portions and the plurality of the lacking grooves.

6. The receptacle connector as claimed in claim 1, wherein two sides of the second contacting portion of each second terminal have at least one discharge opening recessed inward in the lower surface of the insulating housing.

7. The receptacle connector as claimed in claim 1, wherein the plurality of the first terminals include two pairs of first differential signal terminals, at least two portions of two adjacent sides of each pair of the first differential signal terminals are recessed oppositely to form at least one pair of facing first recessed areas, the plurality of the second terminals include two pairs of second differential signal terminals, at least two portions of two adjacent sides of each pair of the second differential signal terminals are recessed oppositely to form at least one pair of facing second recessed areas.

8. The receptacle connector as claimed in claim 7, wherein two sides of an upper surface of each second differential signal terminal are designed as C chamfer angles.

9. The receptacle connector as claimed in claim 1, further comprising a shielding shell surrounding an outside of the insulating housing, and an outer cover covered on the shielding shell, the isolation plate having two extending plates exposed outside from two opposite sides of the insulating housing, two rear ends of two sides of the shielding shell being recessed frontward to form two notches, two rear ends of two sides of the outer cover being connected with two elastic pieces, the two extending plates being received in the two notches, respectively, the two elastic pieces being overlapped with and connected with the two extending plates.

10. A receptacle connector, comprising:

an insulating body having a plurality of limiting protrusions protruded from and projecting beyond a surface of the insulating body, the plurality of the limiting protrusions being arranged in at least one row;

a plurality of terminals positioned to the surface of the insulating body and disposed among the plurality of the limiting protrusions, the plurality of the terminals being isolated by the plurality of the limiting protrusions; and an insulating housing molded outside the insulating body and the plurality of the terminals, a contacting portion of each terminal being exposed outside from a surface of the insulating housing, surfaces of a few of the limiting protrusions being exposed outside from the surface of the insulating housing, the surfaces of the few of the limiting protrusions and the surface of the insulating housing being arranged at the same level and along a horizontal direction;

wherein a front end of the insulating body is connected with at least two step portions arranged at an interval, an upper surface and a lower surface of each step portion protrude oppositely to form an upper limit portion and a lower limit portion, respectively.

11. A receptacle connector, comprising:

an insulating body;

an isolation plate being molded in the insulating body;

a plurality of first terminals molded in the insulating body, each first terminal having a first contacting portion exposed outside from an upper surface of the insulating body, and a first soldering portion exposed at a lower portion of a rear end of the insulating body, the insulating body having a plurality of limiting protrusions protruding downward from a lower surface of the insulating body, the plurality of the limiting protrusions being arranged in two rows and along a front-to-rear direction, the two rows of the plurality of the limiting protrusions being divided into a front row of the limiting protrusions and a rear row of the limiting protrusions;

a plurality of second terminals mounted to the lower surface of the insulating body, and disposed corresponding to intervals of the plurality of the limiting protrusions, each second terminal being limited between two limiting protrusions which are located at two sides of each second terminal, each second terminal having a second contacting portion exposed outside to the lower surface of the insulating body, and a second soldering portion exposed outside to the lower portion of the rear end of the insulating body, the second contacting portions of the plurality of the second terminals being isolated by the front row of the limiting protrusions, the second soldering portions of the plurality of the second terminals being isolated by the rear row of the limiting protrusions; and an insulating housing molded outside the insulating body, the plurality of the first terminals, the plurality of the second terminals and the isolation plate, the first contacting portion of each first terminal being exposed outside from a front end of an upper surface of the insulating housing, the first soldering portion of each first terminal being exposed to a lower portion of a rear end of the insulating housing, the second contacting portions of the plurality of the second terminals being exposed to a lower surface of the insulating housing, and the second soldering portions of the plurality of the second terminals being exposed to the lower portion of the rear end of the insulating housing;

wherein a front end of the isolation plate extends beyond a front surface of the insulating body, a front end of the insulating body is connected with at least two step portions arranged at an interval, the front end of the isolation plate is molded in middles of the at least two step portions, an upper surface and a lower surface of each step portion protrude oppositely to form an upper limit portion and a lower limit portion, respectively.

* * * * *